US006824435B2

(12) United States Patent
Divisi

(10) Patent No.: US 6,824,435 B2
(45) Date of Patent: Nov. 30, 2004

(54) LIFT AND TILT ADJUSTMENT DEVICE FOR AN OUTBOARD MOTOR

(75) Inventor: Walter Divisi, Surrey (GB)

(73) Assignees: Dropsa S.p.A., Milan (IT); Sunbird Investments Limited, Jersey (GB)

( * ) Notice: Subject to any disclaimer, the term of this patent is extended or adjusted under 35 U.S.C. 154(b) by 0 days.

(21) Appl. No.: 10/311,597

(22) PCT Filed: Jun. 20, 2001

(86) PCT No.: PCT/IB01/01117

§ 371 (c)(1),
(2), (4) Date: Dec. 18, 2002

(87) PCT Pub. No.: WO01/98142

PCT Pub. Date: Dec. 27, 2001

(65) Prior Publication Data

US 2003/0148674 A1 Aug. 7, 2003

(30) Foreign Application Priority Data

Jun. 21, 2000 (IT) ..... MI2000A1400

(51) Int. Cl.[7] ..... B63H 20/08
(52) U.S. Cl. ..... 440/61 T; 74/480 B

(58) Field of Search ..... 440/61 R, 61 D, 440/61 E, 61 F, 61 G, 61 H, 61 J; 91/401; 74/480 B

(56) References Cited

U.S. PATENT DOCUMENTS 5,201,680 A * 4/1993 Binversie et al. ..... 440/113
6,402,576 B1 * 6/2002 Klug ..... 440/61 R

* cited by examiner

*Primary Examiner*—Jesus D. Sotelo
(74) *Attorney, Agent, or Firm*—Young & Thompson

(57) ABSTRACT

A lift and tilt adjustment device for an outboard motor includes a lifting member (6) and at least one tilt member (7) for the motor (1). The members are fed with pressurized fluid via a feeder (8) where the members (6, 7) and the feeder are associated with a single support element (5) rotatably connected to a bracket (3) fixed to the boat. The element (5) includes seats (9, 11) for the members (6, 7) and a device (17) for rotatably connecting either the lifting member (6) or the tilt member (7) selectively to the element (5). The rotational movement of the member (6, 7) within its seat (9, 11) occurs without interference with the element (5) to prevent it being dragged into rotation, at least through a portion of a revolution.

23 Claims, 10 Drawing Sheets

LIFT AND TILT ADJUSTMENT DEVICE FOR AN OUTBOARD MOTOR

BACKGROUND OF THE INVENTION

The present invention relates to a lift and tilt adjustment device for a boat outboard motor.

Devices for lifting outboard motors and adjusting their tilt have been known for some time; for example U.S. Pat. No. 5,032,094 describes a device in which the lifting and adjustment members are rigidly connected together.

In these known devices, when the lifting member has to be replaced, for example due to damage or the need to use a member with different technical characteristics, the tilt adjustment members connected to the lifting member also have to be replaced. This negatively affects the time and costs involved in maintaining the devices and obliges the device vendor and/or user to hold a large assortment of devices presenting combinations of lifting and adjustment members with different technical characteristics, such as different lengths of the lifting bar, or different lifting capacities.

Other known devices present separate lifting and adjustment members; however, in this case the means feeding the pressurized fluid for operating said members are rigidly connected to one of said members, said means being connected to the other member by pipes external to the device, which can suffer damage or deterioration due to the stresses induced in said pipes by the rotation of the members, and/or by accidental impact or other stresses (such as rust, or climatic conditions).

SUMMARY OF THE INVENTION

An object of the present invention is to provide a lifting and tilt adjustment device for a boat outboard motor which overcomes the drawbacks of known devices and, in particular, enables the lifting and adjustment members to be replaced independently of each other, while at the same time connecting the pressurized fluid feed means to these members by elements which are protected in such a manner as not to be able to undergo damage by the movement of these members or by external agents.

This and further objects which will be apparent to an expert of the art are attained by a device in accordance with the invention disclosed herein.

BRIEF DESCRIPTION OF THE DRAWINGS

The present invention will be more apparent from the accompanying drawings, which are provided by way of non-limiting example, and in which.

DESCRIPTION OF THE PREFERRED EMBODIMENTS

Figure 1:
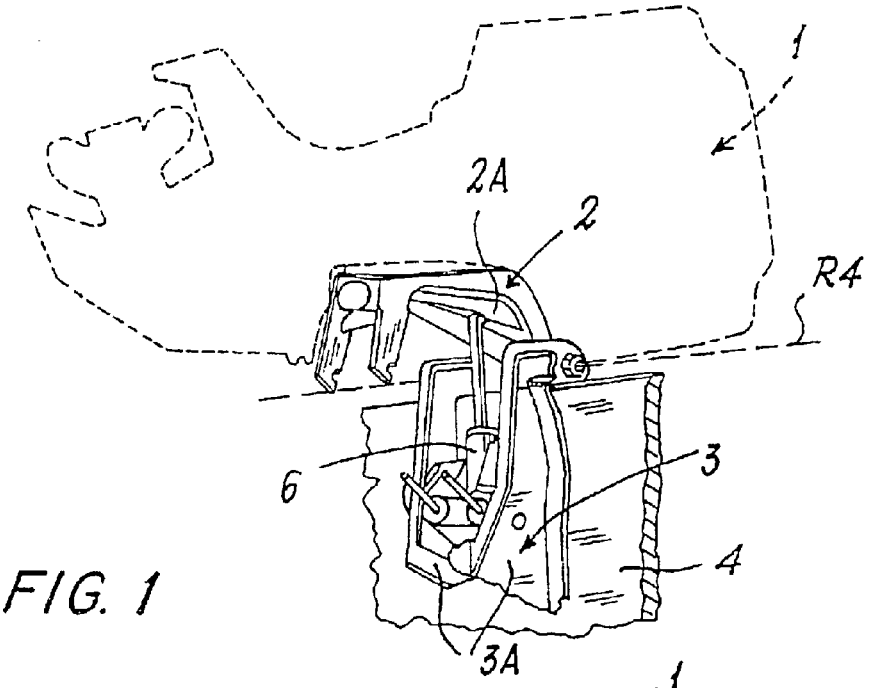
FIGS. 1 and 2 are schematic perspective views of a device of the invention connected to an outboard motor of a boat (these latter only partially represented)

The device of the invention is arranged to lift a boat outboard motor 1 (shown by dashed lines in FIG. 1) and adjust its tilt; the motor 1 is connected to a swivel bracket 2 upperly hinged to a fixed bracket 3 rigidly secured to the stem 4 of the boat. The swivel bracket 2 and fixed bracket 3 are of conventional type. The swivel bracket 2, together with the motor 1, can be swivelled upwards, as far as a position, indicated by dashed lines in FIG. 1, in which the motor is out of the water. For lifting the motor 1 out of the water and, vice versa, for immersing it into the water the device comprises a lifting member 6. When the swivel bracket 2 is lowered (FIG. 2) and the motor is in the water, the inclination of this bracket and, consequently, the inclination of the motor to the fixed bracket 3 and to the stern 4 can be varied by adjustment members 7.

Figure 7:
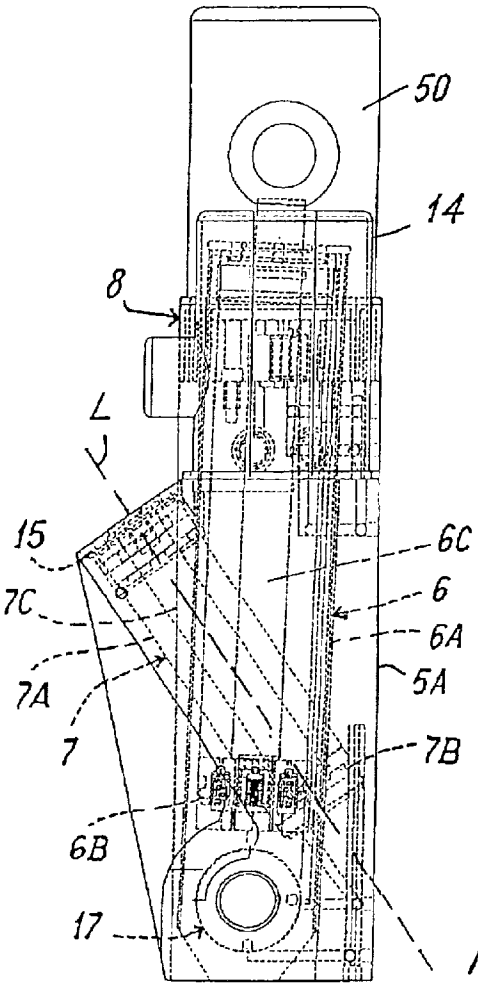
FIGS. 7 and 8 are side views of the device in the operating state of FIGS. 4 and 5 respectively.
Figure 8:
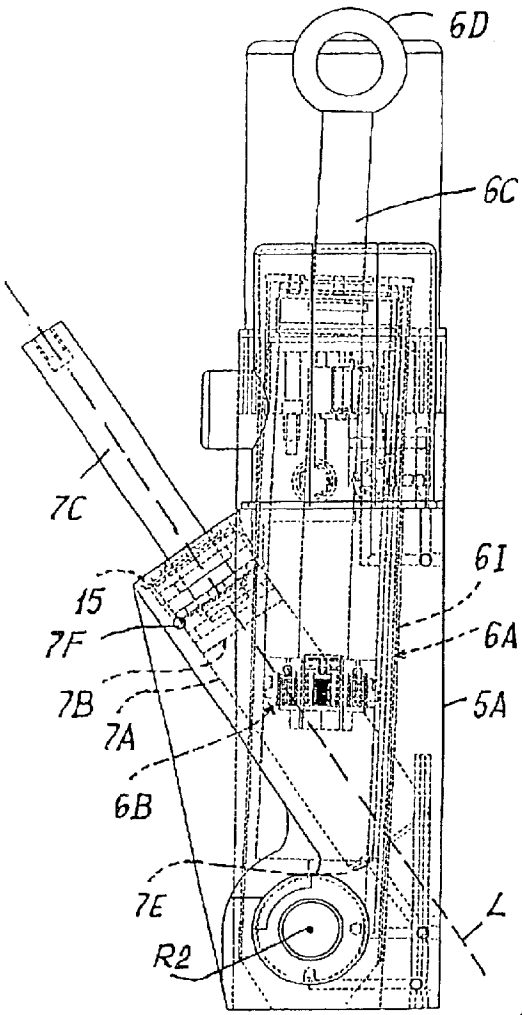
Figure 14:
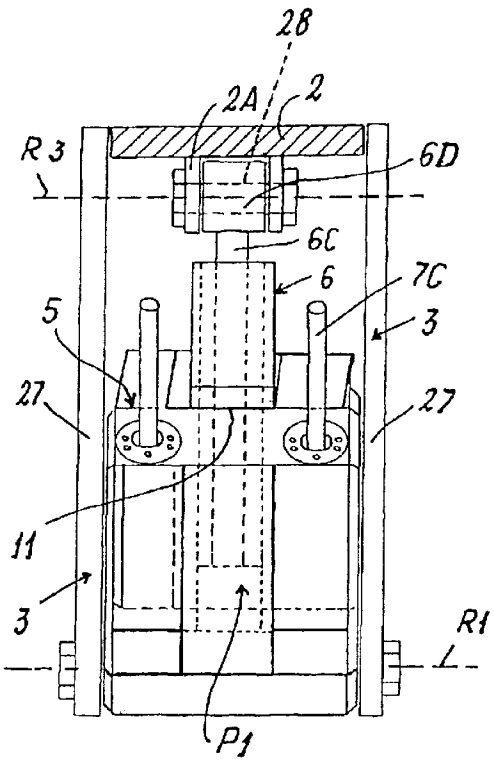
FIG. 14 is a schematic front view, partly in section and with certain device components missing, showing the device associated with a fixed bracket and a swivel bracket in the position for commencing the lift of the boat motor.

The device of the invention comprises a common support element 5 for the lifting member 6, for two tilt adjustment members 7, and for means 8 for feeding to said members 6 and 7 a pressurized fluid, for example oil, contained in a reservoir 14. The lifting 6 and adjustment members 7 are of conventional type, each comprising (FIGS. 11, 7 and 8) a cylindrical body 6A, 7A within which a piston 6B, 7B is movable, to which operating rods 6C and 7C are connected. The pistons 6B, 7B divide the cylindrical chamber of the respective cylinders 6A, 7A into two half-chambers indicated by 6M, 6N and 7M, 7N respectively (FIG. 12), each connected to the device hydraulic circuit through apertures 6E, F (FIG. 11) and 7E, F (FIG. 8). In this manner, by filling or emptying one of the two half-chambers, the pistons and consequently the rods associated with them can be moved in the required manner. The rod 6C of the lifting member 6 presents at its free end a conventional cylindrical head 6D, which is axially holed to enable it to be connected, by a hinge pin 28 (FIG. 14), to two walls 2A (FIGS. 1, 2) of the swivel bracket 2. In this manner the end 6D of the lifting member rod 6C can rotate with respect to the swivel bracket 2, on an axis of rotation R3 (FIG. 3) parallel to the axis of rotation R4 (FIGS. 1 and 2) of the bracket 2.

Figure 5:
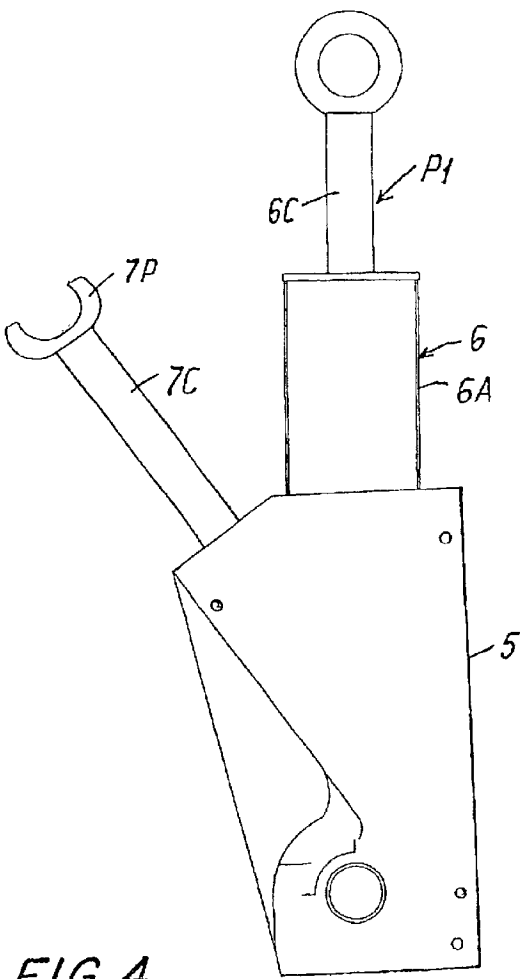
Figure 4:
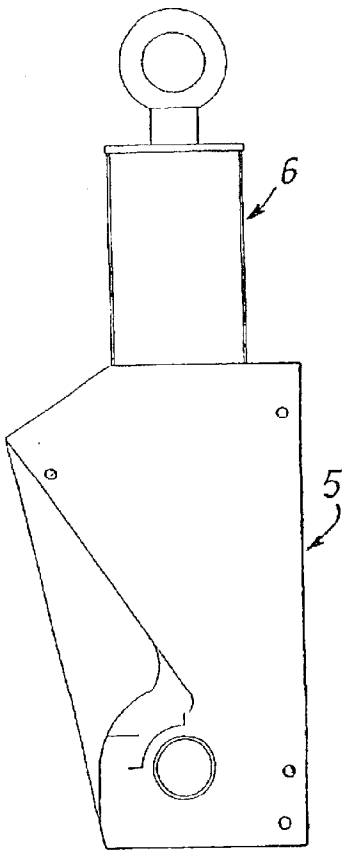
Figure 13A:
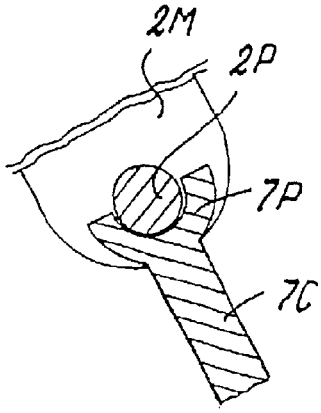

Advantageously, the ends of the rods 7C of the adjustment members are shaped to form a removable connection, preferably of male-female type, with the contacting surface 2B of the swivel bracket. FIG. 13A shows, for example, a rod 7C presenting a "fork" end 7P (see also FIG. 5) arranged to engage with a pin 2P extending from supports 2M (shown partially) connected to that surface of the swivel bracket 2 facing the boat stem.

The fork head 7P and the pin 2P are shaped such that while the adjustment members 7 are exerting thrust, the head 7P and the pin 2P are always in mutual contact without substantial slack. By virtue of this connection between the (arched) thrust surface 7P of the rods 7C and the relative bearing surface, wear of these surfaces is considerably reduced.

Figure 13B:
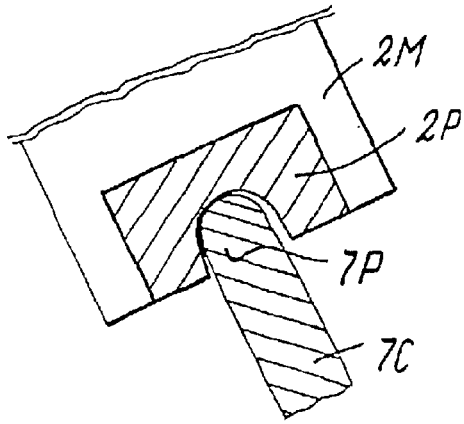

FIG. 13B shows a solution similar to the aforedescribed, and will therefore not be described in detail.

Figure 3:
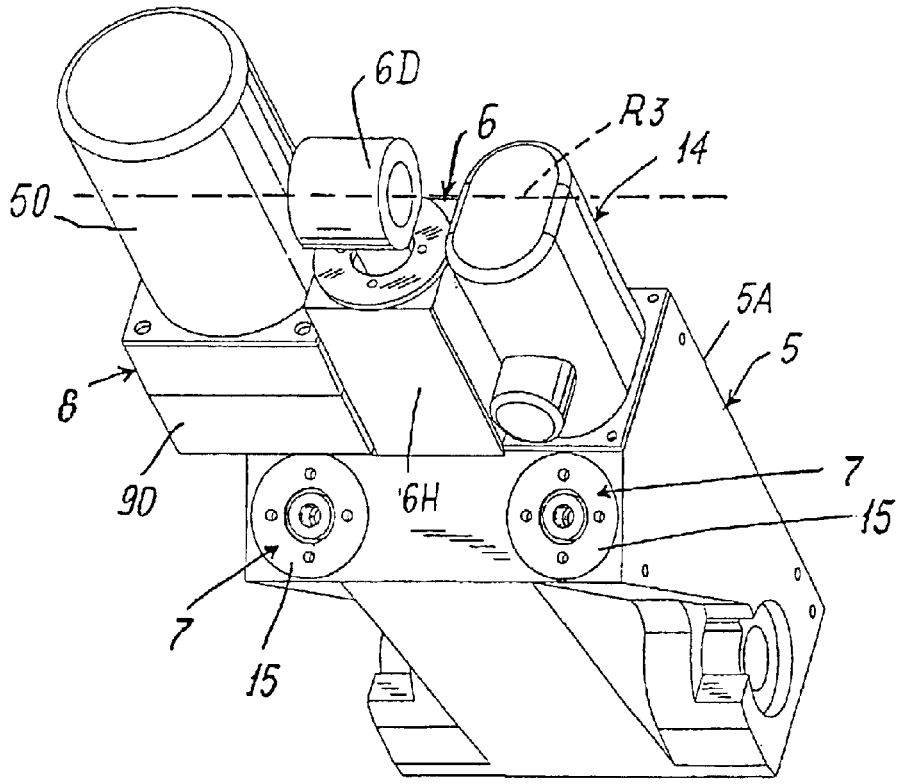
FIG. 3 is a perspective view of a device of the invention in its rest state.

The support element 5 (FIG. 9) is of substantially parallelepiped shape and comprises three distinct and separate seats or cavities 9, 10, 11 (FIG. 9), housing respectively the two adjustment members 7 and, partially, the lifting member 6, a support seat 12 for the pressurized fluid reservoir 14 (FIG. 3), and a support surface 13 (FIG. 9) for the means 8 for feeding the pressurized fluid from the reservoir 14, to the lifting 6 and adjust 7 members and vice versa. The seats 9, 10 for the two motor tilt adjustment members 7 are shaped to house the members 7 without slack, these being rigidly and sealedly secured to the support element 5 by a plug closure element 15 (FIG. 3). The seats 9 and 10 are preferably inclined to the rear wall 5A of the casing 5. The longitudinal axis L of the adjustment members 7 does not intersect the axis of rotation R1 of the casing 5. The seat 11 of the element 5 in which the cylindrical body 6A of the lifting member 6 is partly housed has a greater longitudinal dimension than this body, to enable it to partially rotate (through a portion of a revolution) about the axis of rotation R1 of the support element 5. This rotation, as shown schematically in FIG. 9A, enables the cylindrical body 6A to rotate, with its axis of rotation R1 parallel to the front edge 11A and rear edge 11B of the seat 11 and coinciding with the axis of rotation of the element 5, between two end positions. In a first position, indicated by F2 in FIG. 9A, the cylindrical body 6A abuts against the rear edge 11B of the seat 11, whereas in the other position F2, the cylindrical body is close to the front edge 11A. It should be noted that the fact that the cylindrical body 6A does not abut against the front edge 11A of the seat 11 facilitates the engagement of the heads 7P of the rods 7C of the adjustment members 7 with the relative counter-members 2P of the swivel bracket 2, when this bracket swivels towards the fixed bracket 3. Because of the particular shape of the seat 11 and the fact that the cylinder 6 is lowerly connected to the element 5 such that it can rotate with its axis of rotation R1 coinciding with the axis of rotation of the body 5, the lifting member 6 can move within the seat 11 between the two end positions F1 and F2 in which it is in contact with or close to the edges 11A, 11B of the seat 11. To lowerly connect the cylinder 6 to the support element 5, a hinge pin 17 is used passing through holes 18 (FIG. 9), 19 (FIG. 11) provided in said support element 5 and in the cylindrical body 6A of the member 6.

Figure 10A:
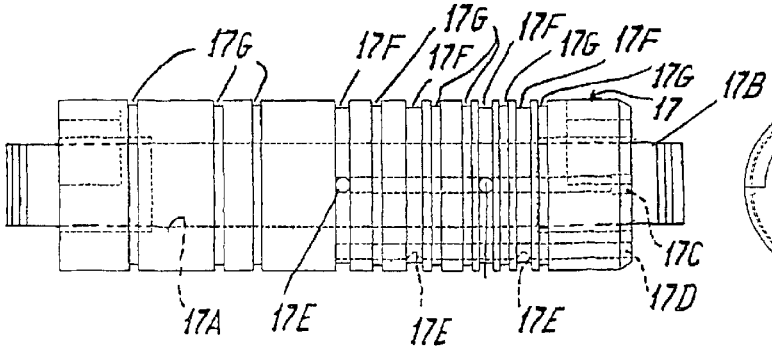
Figure 10B:
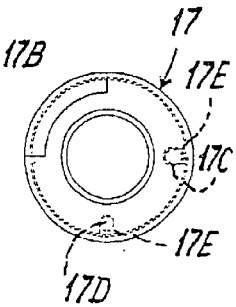

As shown in FIGS. 10A, B, the pin 17 comprises a hole 17A coaxial to the pin itself, to house a further central pin 17A enabling the support element 5 to be connected to the side walls 27 (FIG. 14) of the fixed bracket 3, such that said element 5 can rotate on an axis of rotation R1 with respect to said bracket 3. The pin 17 is also arranged to act as the rotary connection member for the conduits of the device hydraulic circuit provided within the element 5 and lifting member 6. For this purpose the pin comprises (see FIGS. 10A, B) two separate axial conduits 17C, 17D each connected, via radial holes 17E (positioned at different angles along the pin circumference), to annular cavities 17F provided along the outer surface of the pin 17, in positions such that, when the pin is correctly inserted into the element 5 and into the lifting member 6, these annular cavities 17F are connected to the respective mouths of the entry-exit conduits of the pressurized oil of the hydraulic circuit provided in said element 65 and member 6.

Figure 11:
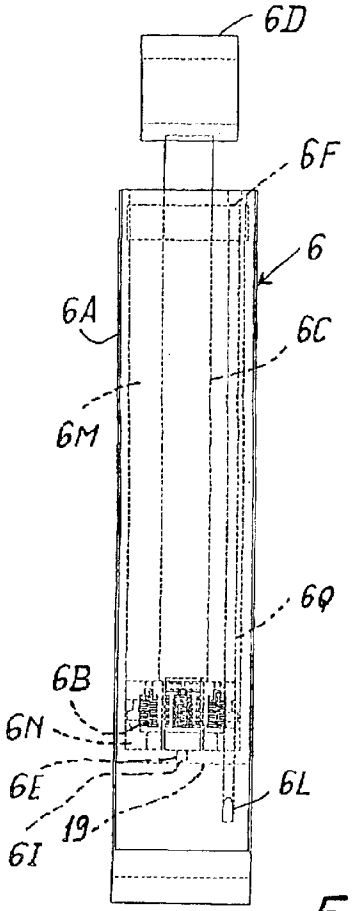
FIG. 11 is a schematic view of a further component of the device.

More specifically, FIG. 11 shows the mouths 6I, 6L of the two conduits 6E, 6Q provided in the body 6A of the lifting member 6 and arranged to connect the two half-chambers 6M, 6N of the lifting member to the device hydraulic circuit. The pin 17 also presents, in its outer surface, annular cavities 17G for housing usual seal gaskets, such as O-rings.

Figure 9:
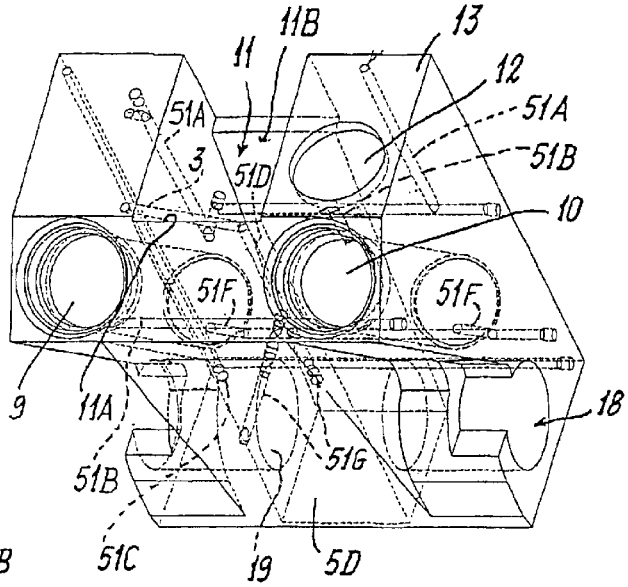
FIG. 9 is a schematic perspective view of the casing containing the device.
Figure 9A:
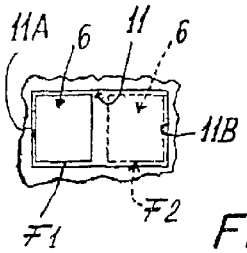
FIG. 9A is a partial schematic view of the device from above, showing the movements of a lifting member thereof, FIGS. 10A, B are side views of a component of the device.
Figure 12:
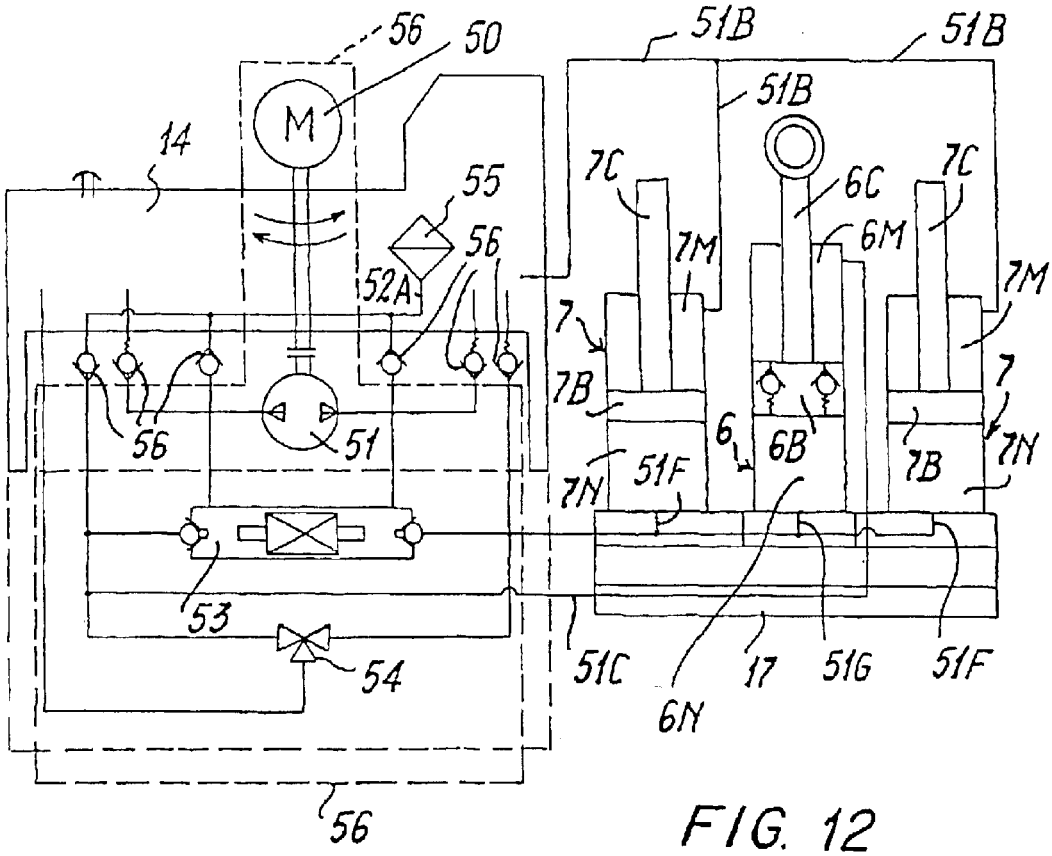
FIG. 12 is a schematic view of the hydraulic circuit of the device, FIGS. 13A, B are schematic side views of two variants of possible connections of two components of the device.

The hydraulic circuit connected to the lifting member 6 and adjustment members 7 is shown in FIG. 12 and is of conventional type; it will therefore not be described in detail hereinafter. This circuit comprises a motor 50 for feeding a pump 51 such that the oil contained in the reservoir 14 can be pumped into one or other of the two half-chambers 6M, N, 7M, N of the lifting member 6 and adjustment members 7. For this purpose the circuit also comprises, as usual, a pilot valve 53, a manual valve 54 to enable the boat motor 1 to be also rotated manually, a filter 55 and a plurality of overpressure or underpressure valves 56. Preferably, the pump 51, the valves 56, the pilot valve 53 and the manual valve 54 are housed in a box casing 90 (FIG. 3) rigidly secured to the element 5, the motor 50 being rigidly connected to this box casing 90 (as shown in FIG. 3). The reservoir 14 is connected to the support element 5, as already described. The reservoir 14, the casing 90 and the relative components, the rotary connection member 17 and the lifting member 6 and adjustment members 7 are connected together by conduits 51A, B, C, D formed within the body of the support element. FIG. 9 shows first conduits 51A for connecting the reservoir 14 to the box casing 90 containing the main components of the hydraulic circuit, conduits 51B for connecting the upper half-chambers 7M of the adjustment members to the reservoir, conduits 51C, D for connecting the rotary connection member 17 to the valve 53, and conduits 51F, G for connecting this member to the half-chambers 7N, 6N of the lifting and adjustment members. The conduits for connecting together the components housed in the box casing 90 are not shown; advantageously, these are also formed by drilling the body in which said components are housed.

When the outboard motor is immersed in the water, i.e. is in its operating position, and its tilt to the stern is to be adjusted, the hydraulic circuit is activated to feed pressurized oil to the two adjustment members 7 and hence cause the relative operating rods 7C to emerge from the support element 5 by a desired length, such as to vary the angle between the swivel bracket 2 and the fixed bracket 3 in the desired manner. Simultaneously with the feed to the adjustment members 7, the hydraulic circuit also feeds the lifting member 6. In this state the lifting member 6 does not however exert any lifting action on the swivel bracket. It should also be noted that during the adjustment of the outboard motor tilt, i.e. during the activation of the members 7, as the heads 7P of the rods 7C of these members are engaged with the counter-members 2P of the swivel bracket, the support element 5, rigid with the adjustment members 7, follows the rotation of the swivel bracket 2. Consequently, during the action of the adjustment members 7, the support element 5 rotates towards the stern of the boat or in the opposite direction, depending on the geometry of the swivel bracket and the connection with the rods 7C. During this adjustment the lifting member also rotates about the axis of rotation R1 of the support element 5, but in a manner independent of the rotation of that element. In this respect, the lifting member 6 is connected to the swivel bracket at a point different from that engaged by the rods 7C of the adjustment members 7, and can also rotate in the seat 11 provided in the support element 5. This seat 11 is preferably shaped such that at the beginning of the adjustment stage, i.e. when the rods 7C are within or slightly projecting from the element 5, the lifting member is in the position F1 (FIG. 9A), with its front side close to the edge 11A of the seat 11. At the end of the adjustment stage, i.e. when the rods 7C are completely extracted, the adjustment member 6 instead lies in the seat 11 in the position F2 (FIG. 9A), i.e. with its rear side in contact with the rear edge 11B of the seat 11.

Figure 2:
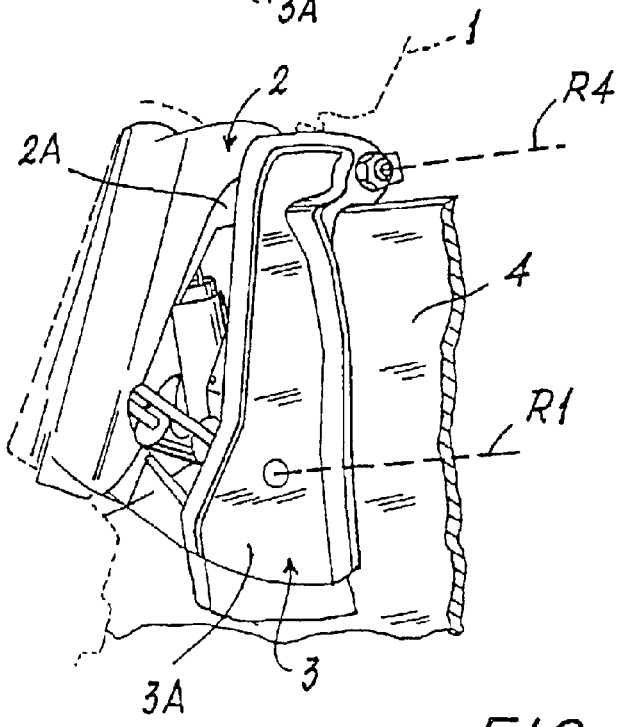
Figure 6:
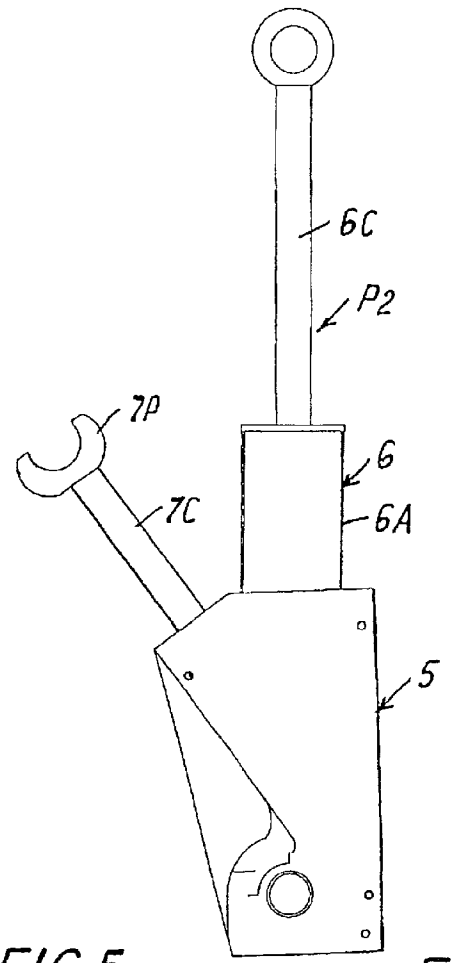
FIGS. 4–6 are schematic side views, in three different operating states (in these views the component indicated by 14 in FIG. 3 is omitted)

When the motor is to be lifted out of the water, the adjustment members 7 are fed to completely extract the rods 7C. Hence, on continuing to feed pressurized oil to the chambers 7N and 6N of the adjustment and lifting members 6 and 7, as the pistons 7B of the adjustment members 7 have reached their end of travel position the entire oil pressure is exerted on the piston 6B of the lifting member 6, to move it from a lower position P1 (FIG. 5) to an upper limit P2 (FIG. 6), in which the rod 6C is completely raised and the motor is out of the water (FIG. 1). When the lifting member 6 also begins to exert a thrust action on the swivel bracket 2, this member is rotated about its axis towards the stern of the boat and abuts against the more inner edge 11B (FIGS. 7 and 5) of the seat 11 in which it is inserted. Hence, during the lifting of the motor, the support element 5, the adjustment members 7 rigid with this element, and the adjustment member 6 form a single body which rotates in the same direction as the rotation of the edge of the lifting member 6 and of the swivel bracket 2 towards the fixed bracket 3 and the stern 4. It should be noted that by virtue of the support element 5, the device is completely modular; in this respect, all its components can be secured to the element 5 independently of each other, and can hence be easily replaced if damaged or for maintenance, if required, or to assemble a device comprising components with particular technical characteristics.

It should also be noted that as all the conduits of the hydraulic circuit are housed within the support element 5 and the box element 56 and are preferably formed by drilling the walls of these elements, they are protected from external agents and/or from possible damage and are not subject to wear.

Figure 15B:
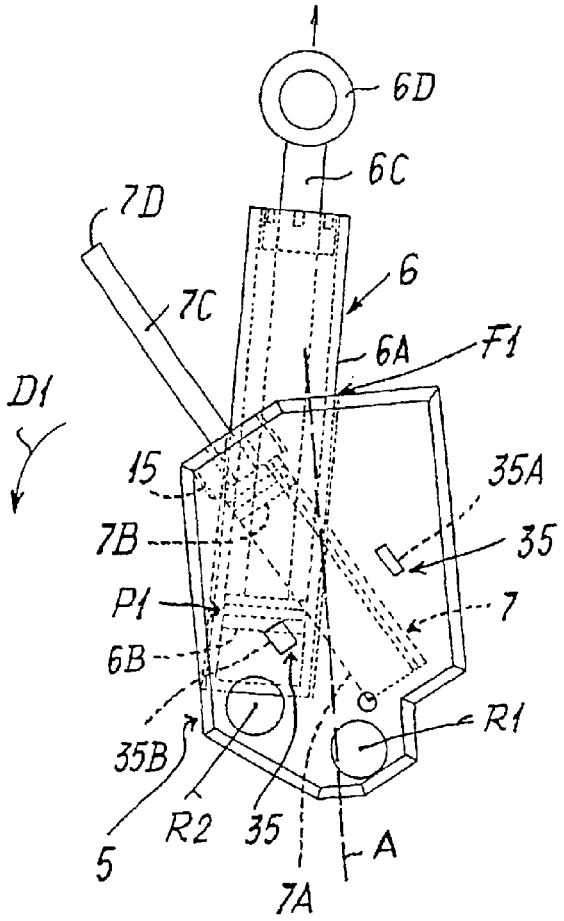
FIGS. 15A, 15B are schematic side views of a second embodiment of the device of the invention, FIGS. 16. 17, 18 are respectively a front perspective, rear perspective and side view of a further embodiment of the device.
Figure 15A:
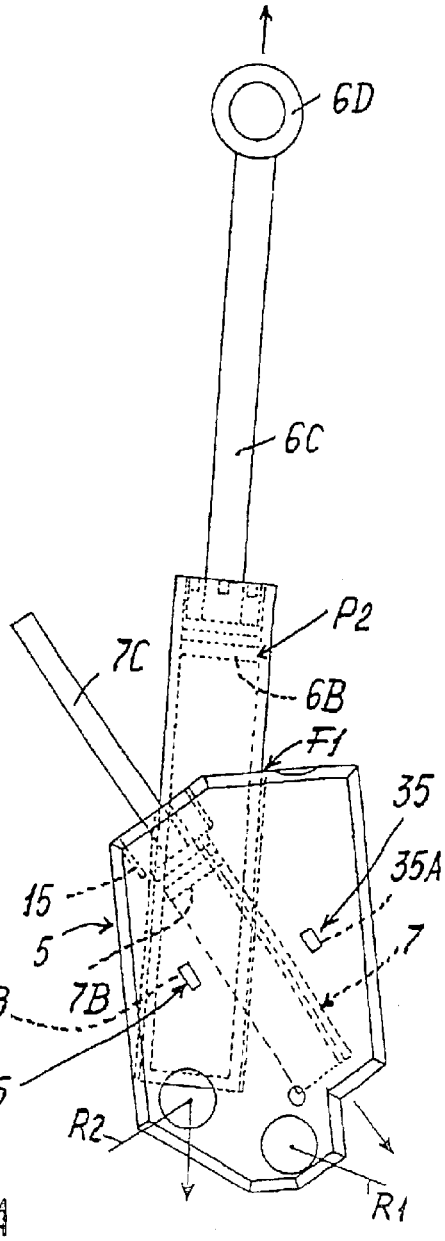
Figure 17:
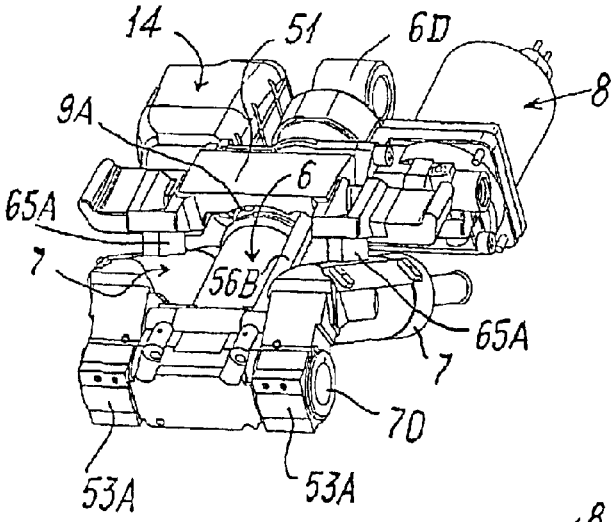
Figure 16:
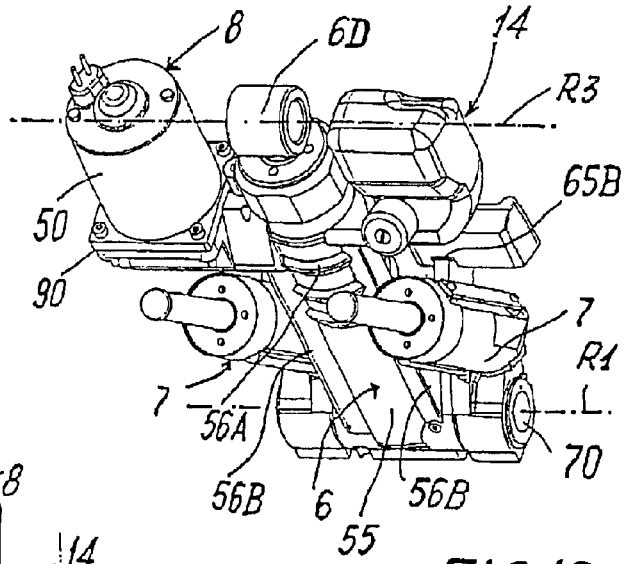
Figure 18:
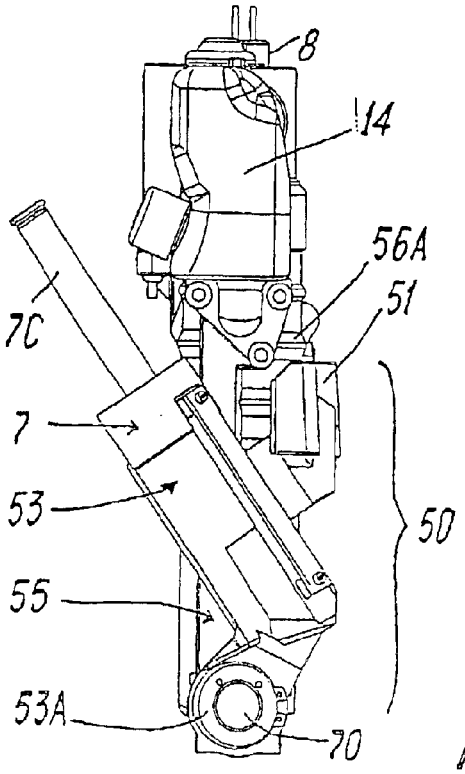
Figure 19:
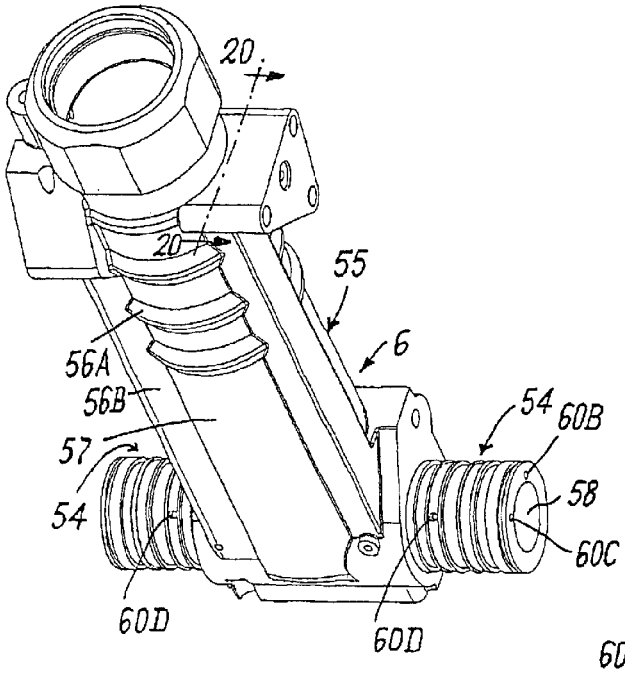
FIGS. 19, 20, 21, 22 are perspective views and sectional views (taken on the lines 20/20 and 22/22 of FIGS. 19 and 21) of two components of the device.
Figure 20:
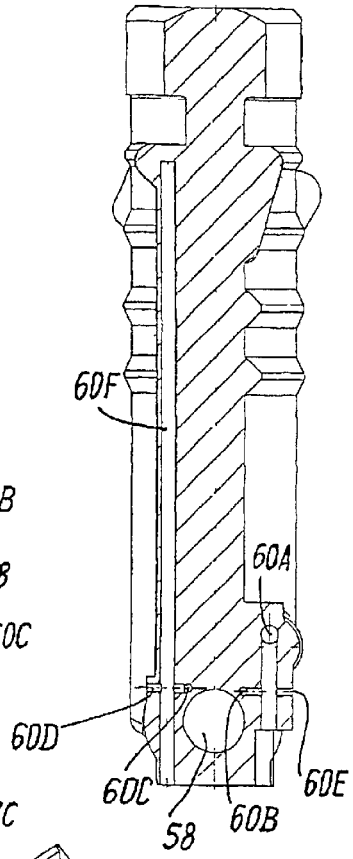
Figure 21:
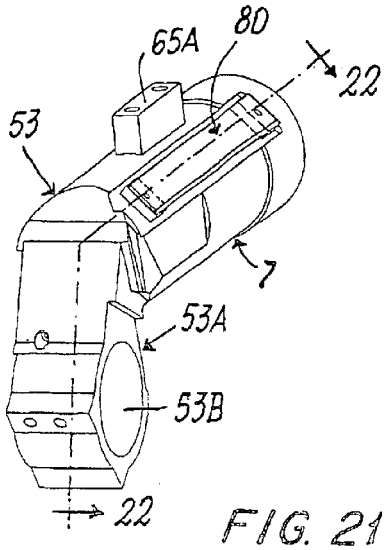
Figure 22:
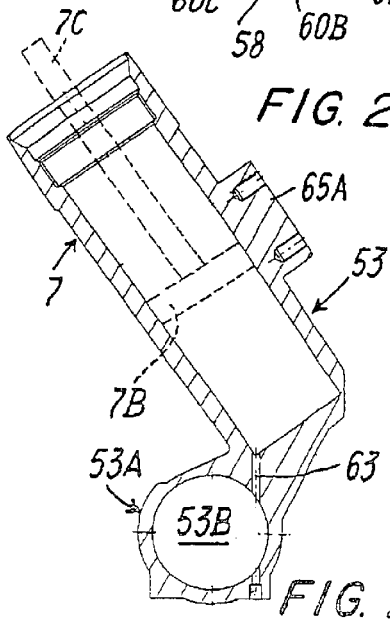

The second embodiment, shown in FIGS. 15A, 15B, is substantially identical to the aforedescribed (elements common to the two embodiments are indicated in FIGS. 15A, 15B by the numerals used in FIGS. 1–14). However, in this variant the axis of rotation R2 of the lifting member 6 is not coaxial with the axis of rotation R1 of the support element 5. Again in this variant the lifting member 6 is movable rotatably within the seat 11, so that during the motor angulation adjustment, i.e. during the operation of the adjustment members 7, it rotates independently of the rotation of the element 5 and of the members 7 rigid with it. By virtue of the offset between the axes of rotation of the lifting member 6 and support element 5, it is also certain that during the descent of the boat motor 1, the element 5 also rotates in the same direction as the swivel bracket 2, so that the heads 7P of the rods 7C reliably lie in the correct position when the swivel bracket 2 is lowered, i.e. in a position such as to be able to engage the counter-members 2P of the swivel bracket 2.

A like effect would also be achieved in the initially described embodiment by even slightly shifting the longitudinal axis of the cylindrical chamber of the lifting member 6 towards the most outer wall 5D (FIG. 9) of the support element 5, while maintaining the member 6 rotatable coaxially with the axis of rotation of the element 5.

Finally it should be noted that the aforedescribed embodiments have been provided by way of example only, and that numerous modifications are possible, all falling within the same inventive concept. For example, a further embodiment could be provided similar to those already described, in which a support element of type similar to the described type 5 is provided, but in which the lifting member 6 is rigidly secured to said support element, whereas the adjustment members 7 are housed in one or two seats similar to the described seat 11, i.e. in seats enabling the adjustment members 7 to at least partly rotate independently of the rotation of the element 5 and of the lifting member 6 rigid with that element, at least during the operation of said adjustment elements 7. In this variant, the axis of rotation of the adjust members 7 is preferably parallel to but not coincident with the axis of rotation R1 of the element 5.

This further variant is neither described in detail nor illustrated hereinafter as it is immediately apparent to the expert of the art in the light of the aforegoing description.

In a further variant, the rods 7C of the adjustment members 7, instead of engaging the counter-members 2P of the swivel bracket, could comprise usual flat heads arranged to act against usual bearing rollers fixed to the swivel bracket 2; using the said configuration, the device operates in a manner totally similar to the aforedescribed. It should however be noted that compared with the aforedescribed embodiment, there would be greater wear of those parts of the adjust members 7 and swivel bracket 2 in mutual contact. In this respect, in the aforedescribed embodiment, by virtue of the engagement between the head 7P of the rods 7C and the counter-members 2P of the bracket 2, and because of the fact that the adjust members 6, being rigid with the bracket 2, can rotate about an axis of rotation parallel to that of the bracket 2 and hence follow the bracket itself and because of the fact that the lifting member 6 can rotate independently of the adjust members, the slack between the heads of the rods 7C and the bearing surfaces of the bracket 2 is reduced to a minimum and hence the wear of these parts is substantially reduced compared with the known solutions.

In a further variant, the support element 5 could be formed as a plurality of parts rigidly joined together to form a single body, or as several parts connected together.

The device of the invention also advantageously comprises means 35 (FIGS. 15A, B) for measuring the angular position of the swivel bracket 2. It is known to measure the position of the swivel bracket 2 by an encoder which measures the rotation of the hinge pin 28 of the swivel bracket 2 (FIG. 9). It has however been found that this arrangement is not totally satisfactory because of the small angle of rotation of the swivel bracket 2 during the adjustment of the motor tilt. According to the invention, measurement is made of the movements of a movable part, for example the piston 7B or rod 7C, present within the adjustment members 7. For this purpose the support element 5 presents, parallel to one of the adjustment members 7, a cavity for receiving a conventional sensor able to determine the position of the piston 7B. This could for example be achieved by using a magnetic field generator, a Hall sensor, and a piston formed of a material able to modify this magnetic field. In FIGS. 15A, B, the reference numeral 35A indicates a seat for housing a sensor for measuring the movement of the piston 7B, and 35B the seat for housing a usual circuit (not shown) for generating a magnetic field. The signal sensed by the sensor is fed to a conventional microprocessor control unit (not shown) for processing this signal and displaying the position of the bracket. It should be noted that the device and the method for measuring the angular position of the swivel bracket 2 can also be used in devices for adjusting the tilt of and lifting a motor of known type, and that the means for measuring the position of the piston 7B and/or rod 7C associated with it could be other conventional measurement means of a type usual to the expert of the art. In addition, the magnetic field generation circuit could be replaced by a permanent magnet secured to the piston 6B.

FIGS. 16, 17, 18, 19 and 20 show a further variant of a device of the invention in which the support element 5 is simplified, compared with the other aforedescribed embodiments. In this respect, the variant of FIGS. 16–20 comprises a support element indicated overall by 50 which, as in the other aforedescribed embodiments, is connected rotatably to the fixed bracket 3 by a pin (not shown) passing through a hole 70, to rotate on an axis of rotation L. The element 50 comprises a rear plate to which the bodies 53 of two adjustment members 7, of type substantially equal to those already described, are rigidly secured, for example by screws.

The bodies 53 present lower protuberances 53A for housing a rotation pin 54 formed integrally with the body 55 of the lifting member 6, of type substantially equal to that already described.

In the variant under examination the plate 51, the bodies 53 of the two adjustment members 7 and their end protuberances 53A form a single element 50 similar to that indicated by 5 in the preceding embodiments, to which the lifting member 6 is connected in a rotatably movable manner. For said element 50, "seats" are identifiable for housing the adjust members 7 and lifting member 6. In this respect, the lifting member 6 can rotate within the space bounded by the bodies 53 of the two adjustment member 7 and by the plate 51, the two adjust members 7 being secured to said plate 51 by connection blocks 65A and respective seats 65B. The member 7 has an inverted T-shaped outer body 55, and presents a substantially cylindrical central part 57 provided with bands 56A and ribs 56B for stiffening purposes and/or for housing oil distribution channels, and, perpendicular to the central part 57, two lower pins 54 comprising an aperture 58 for the passage of a further conventional pin (not shown) for hinging all the aforedescribed components to the fixed bracket 3 secured to the stem of the boat.

The adjustment members 7 and lifting member 6 are of an identical type to the aforedescribed, and will therefore not be further described in detail. The oil reservoir 14 and the means 8 for feeding the pressurized oil to the members 6 and 7 are rigidly secured to the body 55 of the lifting member in conventional manner, for example by screws. The body 55 of the lifting member comprises in its interior a plurality of delivery and return channels for feeding the pressurized oil, by the means 8, to the chambers of the members 6 and 7 and vice versa. More specifically, with reference to FIGS. 19 and 20, the body 55 presents a channel 60A connected to the means 8, and a delivery channel 60B and return channel connected via holes 60D, 60E in the pins 54 to the adjustment members 7 and via the channel 60F to the reservoir 14. Similar channels to the aforedescribed are also present on the other side of the body 55. The pins 54 are shaped similar to the aforedescribed pin 17 and, in addition to the said axial and radial return holes 60C, 60D and delivery holes 60B, 60E, also present annular cavities 61 for seal gaskets (not shown) and annular cavities 62 into which the holes 60D and 60E open, these being positioned and shaped such that when the bodies 53 of the members 7 are correctly positioned on the pins 54, the cavities 62 are connected to the delivery channels 63 and return channels (not shown) provided in said body 53.

The hydraulic circuit of the device is identical to that already described with reference to FIG. 12. The operation of the device and the feed of pressurized fluid to the members 6 and 7 are also identical to that already described. It should be noted that when the motor 1 is in its operating position and the device is not active, the rods 7C of the adjustment members 7 are preferably within the interior of said members and are not "operating", whereas the lifting member 6 is rotated outwards through a predefined angle, for example of about 4° to the bar 51. On activating the means and commencing pressurized oil feed to the hydraulic circuit, when a first predetermined pressure is attained the adjustment members 7 begin to operate, whereas the lifting member does not exert any lifting action on the swivel bracket 2. During this stage the body 55 of the lifting member 6 moves in accordance with the shape of the swivel bracket 2, for example firstly in a direction away from the plate 51 and then towards this latter, whereas the adjustment members 7 do not vary their angular position during their entire activation period, forming one piece with the stern bracket 3.

Hence, as in the preceding embodiments, with this variant, during the "operating" stage of the adjustment members 7 these again remain in a fixed position whereas the lifting member 6 is free to rotate, even if through a small angle, about the axis L connecting the element 50 to the fixed bracket 3.

When the motor 1 is to be lifted, the adjustment members 7 present their rods 7C completely extracted and the relative pistons in their end-of-travel positions, consequently on continuing to feed pressurized oil into the hydraulic circuit all the pressure acts on the piston of the lifting member 6 which by undergoing movement causes the desired upward rotation of the bracket 2, with consequent lifting of the motor 1. During the activation of the member 6 the body 55 of this member moves towards the plate 51 until it makes contact with it, after which the entire device rotates towards the stern 4.

Hence, as in the preceding embodiments, with this variant, during the "operating" stage of the member 6 there is simultaneous rotation of the entire lifting and adjustment device, the adjustment members 7 hence also rotating.

To return the motor to its operating position, as the cylinder of the lifting member 6 is double acting it is fed such as to make the rod 6C retract into the body 55, while the rods 7C of the adjustment members 7 are thrust into the body by the weight of the motor.

Advantageously, as in the preceding embodiment means 35 are also provided in this variant to determine the angular position of the swivel bracket 2. For this purpose, on the body 53 of the adjustment members 7 there is fixed a sensor 80, for example a Hall sensor, arranged to measure the variations in magnetic field as the position of the magnetized piston 7B provided inside the member 7 varies (the piston 7B is either itself magnetized or comprises a magnet, for example a magnetic ring fixed to the piston). As already described, the signal from the magnetic field sensor is used by a control unit to calculate the angular position of the swivel bracket 2.

In a further variant, not shown, the pressurized fluid feed means 8 and/or the reservoir 14 are secured to the plate 51 and/or to the adjustment members 7. In this embodiment said plate 51 and/or the body 53 of the members 7 present channels forming the hydraulic circuit necessary for the operation of the device.

What is claimed is:

1. A lift and tilt adjustment device for a boat outboard motor (1), said motor (1) being secured to a first bracket (2) swivelling about a first axis (R4) parallel to the stern (4) of the boat, and connected rotatably to a fixed second bracket (3) secured to said stern (4), the device being of the type comprising:

a member (6) for lifting the motor out of the water into a rest position, said member (6) being rotatably connected to said two brackets (2, 3), on axes of rotation (R1 R3; R2) parallel to that (R4) of the swivel bracket (2); for adjusting the tilt of the motor (1), at least one member (7) arranged to engage with the swivel bracket (2) only when the motor is in the water in an operating position; and means (8, 14) for feeding a pressurized fluid to said lifting member (6) and adjustment member (7), said means comprising a plurality of conduits (20A, B; 60A–F) for distributing said fluid;

said device comprising common support element (5, 50) for said lifting member (6), for said tilt adjustment member (7) and for said feed means (8, 14), said support element (5, 50) comprising means (26) for connecting it rotatably to the fixed bracket (3) with its axis of rotation (R1) parallel to the axis of rotation (R4) of the swivel bracket (2), said support element (5, 50) comprising: seats (9, 11, 51, 65A) for housing the lifting member (6) and said at least one adjustment member (7), and means (17, 54) for rotatably connecting one of said lifting member (6) and said adjustment member (7) to said support element (5), to enable it to rotate about an axis (R1) parallel to the axis of rotation (R4) of the swivel bracket (2), one of said seats (9, 11, 51, 65A) for the lifting member (6) and the adjustment member being shaped in such a manner as to enable the corresponding member to undergo said rotation at least through a portion of a revolution without interfering with the walls (11A, 11B) of the seat (11), to prevent said support element (5, 50) also being dragged into rotation, at least through said portion of a revolution, wherein at least one of the support element (5, 50) and the body (53, 55) of the adjustment member (7) and lifting member (6) house in their interior the plurality of conduits (51A–G) for distributing the pressurized fluid to said lifting member (6), and tilt adjustment member (7) and the distribution conduits (51A–G) comprise through holes formed in at least on of the support element (5, 50) and the bodies (53, 55) of the adjustment member (7) and lifting member (6).

2. A device as claimed in claim 1, characterised in that the lifting member (6) and tilt adjustment member (7) are removably connected to the support element (5, 50).

3. A device as claimed in claim 1, characterised in that the seat (11, 51) for the member rotatably connected to the support element (5, 50) is shaped such as to enable said member to rotate through an angular portion sufficient to prevent the support element (5, 50) and said member connected rotatably to said element (5, 50) from interfering with the walls of said seat and undergoing rotation, at least during the motor tilt adjustment.

4. A device as claimed in claim 1, characterised in that the axes of rotation (R1, R2) of the support element (5, 50) and of the member connected rotatably to said element (5, 50) are parallel to each other.

5. A device as claimed in claim 1, characterised in that the axes of rotation (R1, R2) of the support element (5) and of the member connected rotatably to said rotation element are separate and parallel to each other.

6. A device as claimed in claim 1, characterised in that a reservoir (14) for the pressurized fluid is connected to at least one of the support element (5) and the body (53, 55).

7. A device as claimed in claim 1, characterised in that a containing element (90) for housing a plurality of components of a hydraulic circuit for distributing the pressurized fluid to the lifting member (6) and adjustment member (7) is connected to the support element, said components comprising a pump (51), a motor (50) and valve members (56; 53, 54).

8. A device as claimed in claim 7, characterised in that at least one movable component of the tilt adjustment member (7) is formed of a material able to one of vary and generate a magnetic field.

9. A device as claimed in claim 7, characterised in that one of the support element (5) and the piston (7B) and a rod (7C) of the adjust member (7) presents means for generating a magnetic field.

10. A device as claimed in claim 1, characterised in that the adjustment member (7) presents members (7P) arranged to removably engage counter members (2P) provided in the swivel bracket (2) so as to connect together said members (7) and said swivel bracket (2) when said member acts on said bracket (2).

11. A device as claimed in claimed in claim 10, characterised in that the engagement members (7P) and counter-members (2P) are of male-female type.

12. A device as claimed in claim 11, characterised in that the engagement members (7P) are provided at one end of a rod (7C) connected to a piston (7B) of the adjustment member (7), said engagement members (7P) being movable relative to the engagement counter-members (2P) while the adjustment member (7) is acting on the bracket.

13. A lift and tilt adjustment device for a boat outboard motor (1), said motor (1) being secured to a first bracket (2) swivelling about a first axis (R4) parallel to the stern (4) of the boat, and connected rotatably to a fixed second bracket (3) secured to said stern (4), the device being of the type comprising:

a member (6) for lifting the motor out of the water into a rest position, said member (6) being rotatably connected to said two brackets (2, 3), on axes of rotation (R1, R3; R2) parallel to that (R4) of the swivel bracket (2); for adjusting the tilt of the motor (1), at least one member (7) arranged to engage with the swivel bracket (2) only when the motor is in the water in an operating position; and means (8, 14) for feeding a pressurized fluid to said lifting member (6) and a adjustment member (7), said means comprising a plurality of conduits (20A, B; 60A–F) for distributing said fluid;

said device comprising a common support element (5, 50) for said lifting member (6), for said tile adjustment member (7) and for said feed means (8, 14), said support element (5, 50) comprising means (26) for connecting it rotatably to the fixed bracket (3) with its axis of rotation (R1) parallel to the axis of rotation (R4) of the swivel bracket (2), said support element (5, 50) comprising: seats (9, 11, 51, 65A) for housing the lifting member (6) and said at least one adjustment member (7), and means (17, 54) for rotatably connecting one of said lifting member (6) and said adjustment member (7) to said support element (5), to enable it to rotate about an axis (R1) parallel to the axis of rotation (R4) of the swivel bracket (2), on of said seats (9, 11, 51, 65A) for the lifting member (6) and the adjustment member being shaped in such a manner as to enable the corresponding member to undergo said rotation at least through a portion of a revolution without interfering with the walls (11A, 11B) of the seat (11), to prevent said support element (5, 50) also being dragged into rotation, at least through said portion of a revolution, wherein the member rotatably connected to the support element (5, 50) is the lifting member (6), the adjustment member (7) being rigid with said support element (5, 50) and angularly locked within its seat (9).

14. A device as claimed in claim 13, wherein at least on of the support element (5, 50) and the body (53, 55) of the adjustment member (7) and lifting member (6) house in their interior the plurality of conduits (51A–G) for distributing the pressurized fluid to said lifting member (6) and tilt a adjustment member (7).

15. A device as claimed in claim 14, characterised in that the distribution conduits (51A–G) comprise through holes formed in at least one of the support element (5, 50) and the bodies (53, 55) of the adjustment member (7) and lifting member (6).

16. A lift and tilt adjustment device for a boat outboard motor (1), said motor (1) being secured to a first bracket (2) swivelling about a first axis (R4) parallel to the stern (4) of the boat, and connected rotatably to a fixed second bracket (3) secured to said stern (4), the device being of the type comprising:

a member (6) for lifting the motor out of the water into a rest position, said member (6) being rotatably connected to said two brackets (2, 3), on axes of rotation (R1, R3; R2) parallel to that (R4) of the swivel bracket (2); for adjusting the tilt of the motor (1), at least one member (7) arranged to engage with the swivel bracket (2) only when the motor is in the water in an operating position; and means (8, 14) for feeding a pressurized fluid to said lifting member (6) and adjustment member (7), said means comprising a plurality of conduits (20A, B; 60A–F) for distributing said fluid;

said device comprising a common support element (5, 50) for said lifting member (6), for said tilt adjustment member (7) and for said feed means (8, 14), said support element (5, 50) comprising means (26) for connecting it rotatably to the fixed bracket (3) with its axis of rotation (R1) parallel to the axis of rotation (R4) of the swivel bracket (2), said support element (5, 50) comprising: seats (9, 11, 51, 65A) for housing the lifting member (6) and said at least one adjustment member (7), and means (17, 54) for rotatably connecting one of said lifting member (6) and said adjustment member (7) to said support element (5), to enable it to rotate about an axis (R1) parallel to the axis of rotation (R4) of the swivel bracket (2), one of said seats (9, 11, 51, 65A) for the lifting member (6) and the adjustment member being shaped in such a manner as to enable the corresponding member to undergo said rotation at least through a portion of a revolution without interfering with the walls (11A, 11B) of the seat (11), to prevent said support element (5, 50) also being dragged into rotation, at least through said portion of a revolution, wherein the member rotatably connected to the support element (5, 50) is the adjustment member (7), the lifting member (6) being rigid with said support element and angularly locked within its seat (11).

17. A lift and tilt adjustment device for a boat outboard motor (1), said motor (1) being secured to a first bracket (2) swivelling about a first axis (R4) parallel to the stern (4) of the boat, and connected rotatably to a fixed second bracket (3) secured to said stern (4), the device being of the type comprising:

a member (6) for lifting the motor out of the water into a rest position, said member (6) being rotatably connected to said two brackets (2, 3), on axes of rotation (R1, R3; R2) parallel to that (R4) of the swivel bracket (2); for adjusting the tilt of the motor (1), at least one member (7) arranged to engage with the swivel bracket (2) only when the motor is in the water in an operating position; and means (8, 14) for feeding a pressurized fluid to said lifting member (6) and adjustment member (7), said means comprising a plurality of conduits (20A, B; 60A–F) for distributing said fluid;

said device comprising a common support element (5, 50) for said lifting member (6), for said tile adjustment member (7) and for said feed means (8, 14), said support element (5, 50) comprising means (26) for connecting it rotatably to the fixed bracket (3) with its axis of rotation (R1) parallel to the axis of rotation (R4) of the swivel bracket (2), said support element (5, 50) comprising: seats (9, 11, 51, 65A) for housing the lifting member (6) and said at least one adjustment member (7), and means (17, 54) for rotatably connecting one of said lifting member (6) and said adjustment member (7) to said support element (5), to enable it to rotate about an axis (R1) parallel to the axis of rotation (R4) of the swivel bracket (2), one of said seats (9, 11, 51, 65A) for the lifting member (6) and the adjustment member being shaped in such a manner as to enable the corresponding member to undergo said rotation at least through a portion of a revolution without interfering with the walls is (11A, 11B) of the seat (11), to prevent said support element (5, 50) also being dragged into rotation, at least through said portion of a revolution, further comprising at least one element (80) for measuring the position of a movable component (7B, 7C) during the adjustment activity of the motor tilt adjustment member (7).

18. A device as claimed in claim 17, characterised in that the movable component is one of a piston (7B) and a rod (7C) connected to said piston of the tilt adjustment member (7).

19. A device as claimed in claim 17, characterised in that the measuring element is a sensor for measuring magnetic field variations.

20. A device as claimed in claim 17, characterised in that the support element (5) presents a seat (35) for housing the measuring element (80).

21. A lift and tilt adjustment device for a boat outboard motor (1), said motor (1) being secured to a first bracket (2) swivelling about a first is (R4) and connected to a fixed second bracket (3), the device being of the type comprising:

a member (6) for lifting the motor out of the water into a rest position, said member (6) being rotatably connected to said two brackets (2, 3), on axes of rotation (R1, R3; R2) parallel to that (R4) of the swivel bracket (2); for adjusting the tilt of the motor (1), at least one member (7) arranged to engage with the swivel bracket (2) only when the motor is in the water in an operating position; and means (8, 14) for feeding a pressurized fluid to said lifting member (6) and adjustment member (7), said means comprising a plurality of conduits (20A, B; 60A–F) for distributing said fluid;

said device comprising a support element (50) comprising a support structure (51) to which said adjustment members (7) are rigidly secured, said element (50) and said lifting member (6) comprising members (53A, 54) arranged to engage with each other in such a manner as to enable said lifting member to rotate, at least through a portion of a revolution, on an axis of rotation (R1) parallel to that (R4) of said first bracket (2) without interfering with said element (50), to prevent said support element (5, 50) also being dragged into rotation, at least through said portion of a revolution, wherein at least one of the support element (5, 50) and the body (53, 55) of the adjustment member (7) and lifting member (6) house in their interior the plurality of conduits (51A–G) for distributing the pressurized fluid to said lifting member (6), and tilt adjustment member (7) and the distribution conduits (51A–G) comprise through holes formed in at least one of the support element (5, 50) and the bodies (53, 55) of the adjustment member (7) and lifting member (6).

22. A device as claimed in claim 21, characterised in that the adjustment member (7) presents a body (53) comprising the adjust member itself and the member (53A) for its connection to the lifting member (6).

23. A device as claimed in claim 21, characterised in that the lifting member (6) presents a part (57) comprising the lifting member itself and the member (54) for its connection to the support element (50).

* * * * *